US005511761A

United States Patent [19]

Schultz

[11] Patent Number: 5,511,761

[45] Date of Patent: Apr. 30, 1996

[54] APPARATUS AND METHOD FOR FORMING MONOLITHIC FOOTINGS AND FOUNDATION WALLS

[76] Inventor: Allan A. Schultz, Rte. 2, Box 79, New Richland, Minn. 56072

[21] Appl. No.: 191,071

[22] Filed: Feb. 3, 1994

[51] Int. Cl.[6] ..... E04G 11/20

[52] U.S. Cl. ..... 249/34; 249/40; 249/155

[58] Field of Search ..... 249/13, 18, 34, 249/40, 44, 47, 155; 52/293.1; 405/43, 229

[56] References Cited

U.S. PATENT DOCUMENTS

| | | | |
|---|---|---|---|
| 940,463 | 11/1909 | Kay | 249/34 |
| 1,142,887 | 6/1915 | Keenan | 249/34 |
| 1,607,072 | 11/1926 | Gremel | 249/34 |
| 2,107,427 | 2/1938 | Schwarzler | 249/193 |
| 2,162,869 | 6/1939 | Symons | 249/42 |
| 2,250,064 | 7/1941 | Jorsch | 249/34 |
| 2,251,775 | 8/1941 | Arrighini | 249/34 |
| 2,511,829 | 6/1950 | Arrighini et al. | 249/34 |
| 2,614,311 | 10/1952 | Shook | 249/34 |
| 2,640,249 | 6/1953 | Symons | 249/191 |
| 2,859,503 | 11/1958 | Hennig | 249/191 |
| 2,997,769 | 8/1961 | Bowden | 249/219.1 |
| 3,017,722 | 1/1962 | Smith | 405/43 |
| 3,035,321 | 5/1962 | Hennig | 249/27 |
| 3,086,272 | 4/1963 | Ruth et al. | 249/41 |
| 3,103,730 | 9/1963 | Carlton | 249/45 |
| 3,130,470 | 4/1964 | Bowden et al. | 249/192 |
| 3,137,909 | 6/1964 | Bonin et al. | 249/191 |
| 3,144,701 | 8/1964 | Bowden | 249/196 |
| 3,169,294 | 2/1965 | Bonin et al. | 249/196 |
| 3,171,185 | 3/1965 | Anderson | 249/34 |
| 3,171,186 | 3/1965 | Bowden | 249/191 |
| 3,204,918 | 9/1965 | Bonin et al. | 249/191 |
| 3,246,871 | 4/1966 | Bowden | 249/189 |
| 3,357,673 | 12/1967 | Williams | 249/194 |
| 3,383,817 | 5/1968 | Gregori | 52/309.11 |
| 3,396,936 | 8/1968 | Bowden | 249/214 |
| 3,429,547 | 2/1969 | Schimmel | 249/192 |
| 3,452,960 | 7/1969 | Bowden | 249/40 |
| 3,748,806 | 7/1973 | Talandis | 52/404.1 |
| 4,744,541 | 5/1988 | Carlson et al. | 249/192 |
| 5,080,321 | 1/1992 | Carlson | 249/196 |
| 5,207,931 | 5/1993 | Porter | 249/34 |

FOREIGN PATENT DOCUMENTS

| | | | |
|---|---|---|---|
| 971343 | 7/1975 | Canada | 249/34 |

OTHER PUBLICATIONS

Flyer dated Jun. 14, 1989, published by EPM Systems, Inc.

Brochure entitled *Crown 44 Concrete Form Panels,* dated 1985, published by CrownForest.

Brochure entitled *Symons Steel–Ply; Symons Resi–Ply; Symons Silver; Symons Street Smart,* dated 1990, published by Symons Corporation.

Brochure entitled *Symons Silver Aluminum Forming System,* dated 1991, published by Symons Corporation.

Brochure entitled *Resi–Ply Residential Forming System,* dated 1991, published by Symons Corporation.

Brochure entitled *Application Guide Steel–Ply Forming System,* dated 1990, published by Symons Corporation.

*Primary Examiner*—James P. Mackey

*Attorney, Agent, or Firm*—Schroeder & Siegfried

[57] ABSTRACT

A wall forming apparatus for constructing monolithic concrete footings and walls of a building foundation which includes a plurality of relatively light-weight prefabricated wall forming panels connected together and positioned to form a plurality of opposing monolithic footing and wall forming units, each panel having an outer rigid framework from which an adjustable footing form depends, the opposing footing forms of the opposing footing and wall forming units being devoid of any structure extending directly therebetween, and the framework of each panel being constructed of sufficient rigidity and with sufficient cross-sectional dimensions so as to prevent canting and sagging of the footing and wall forming units formed by the panels when interconnected. Construction and proper placement of the integral footing and wall forming units is accomplished by placing the panels side-by-side on a flat surface and rigidly interconnecting the same at the adjacent upper and lower corners thereof, and thereafter hoisting each constructed footing and wall forming unit into desired position through the use of a crane or other suitable hoisting device.

19 Claims, 5 Drawing Sheets

65
65
34
3
36
11
21
27
19
21
19
35
35
17
19
27
19
25
25
27
19
21
19
35
35
19
27
27
13
9

APPARATUS AND METHOD FOR FORMING MONOLITHIC FOOTINGS AND FOUNDATION WALLS

BACKGROUND OF THE INVENTION

The present invention described herein is related generally to a concrete wall forming system for use in primarily residential and light commercial building construction. More particularly, the present invention is related to prefabricated monolithic footing and wall forming members or panels which are relatively light weight for manageability, but rigidly constructed and gang formed or interconnected to form complete integral footing and wall forming units which are substantially self-straightening and non-sagging.

Perhaps the greatest cost in new home construction is the cost of labor. The cost of labor is generally based upon an estimation of the time required to complete a given job. Therefore, there exists a continuing desire to lessen the time required for performing such work, and thereby increase the efficiency of the operation. Concrete contractors continually struggle with this problem because of the extreme difficulty which they encounter in trying to find and keep personnel that are capable of lifting and handling concrete forms in excess of 80 pounds on a daily basis, in adverse conditions. The physical wear on the personnel causes slowdowns in production as well as a relatively high rate of turnover in personnel, which in turn leads to an inefficient operation. Thus, concrete contractors are continually seeking methods by which the heavy physical labor involved in this work may be lessened.

When a poured concrete foundation for a home or other building is being constructed, a substantial amount of time and heavy physical labor is generally required for assembling footing form members, and thereafter assembling the foundation wall forming members which rest upon the concrete footings that have been previously formed and poured. Frequently, the footing forms and wall forming panels are separately constructed on the job site, by hand, and often times by separate contractors. Because each contractor will generally do its own layout work, more time is consumed and the owner of the building consequently pays twice for the same layout work.

Also, hand assembled concrete forms require numerous braces and support members to hold the same in an aligned upright position to receive the concrete therebetween. Such hand assembled wall forming panels frequently have surface irregularities and are constructed such that pillowing (outward bowing of inner surface panel) and alignment problems may occur. All of the above, along with the heavy physical labor involved, greatly increases the necessary time and labor cost involved in constructing the foundation of such a building.

Alternatively, once the conventional footing forms are assembled and the concrete footings are poured, the foundation walls may be hand assembled by laying concrete blocks, which also requires a substantial amount of time and heavy physical labor. In fact, this is still the most prevalent method of constructing foundation walls in the residental housing industry.

The substantial amount of time and heavy physical labor involved with either of the above methods has led the construction industry to seek new methods of constructing such footings and foundation walls which are less physically taxing, more efficient, and less costly. For example, the Steel-Ply form system, which was developed by Symons Corporation, consists of a plurality of prefabricated 2'×8' wall forming panels that are uniform and symmetrical in construction, and can be hand assembled on-site, or gang formed into larger wall forming units which are set in place and stripped via the use of a crane.

The advent of the Steel-Ply wall forming system reduced the amount of time necessary in constructing poured foundation walls, once the footings were properly constructed. However, such a system still requires additional time and labor to assemble the footing forms and pour the concrete footings prior to the assembly and setting of the prefabricated wall forming panels. Such footing forms must also be disassembled separately, which also adds additional cost to a project. Additionally, whether such Steel-Ply panels are hand assembled on-site or ganged formed, additional walers and strongbacks must be secured across the backside thereof in order to gain proper alignment of such panels so as to ensure that the resulting poured concrete wall is straight within the required specification therefor. For such reasons, it can be seen that costly time and heavy physical labor is still required both for assembly and disassembly of the required footing forms, and for assembly and disassembly of the interconnected panels and their required walers and strongbacks which are used to properly align the interconnected panels.

There have also been other wall forming systems developed in the past which allow the footings and foundation walls to be poured simultaneously. However, such conventional wall forming systems require on-site hand assembly which, as already pointed out, is extremely time consuming and labor intensive. In addition, the footing forms for such a system support the wall forming panels, and are therefore generally reinforced by interconnecting members which extend between opposing footing forms, and are ultimately buried within the footings once the concrete hardens. This creates substantial material waste and makes such forming systems more difficult to disassemble and strip once the foundation walls have hardened. This, of course, again increases the time, labor and cost involved in the construction of foundation walls, which is undesirable.

From the above, it can be seen that there is a definite need in the building industry, and particularly in new home construction, for a more efficient, less costly means of constructing the necessary footings and foundation walls for housing projects. More particularly, there is a distinct need for a wall forming system which has relatively light-weight prefabricated wall forming panels that include means for monolithically forming associated footings of desired width. Such panels must be constructed uniformally and symmetrically so as to be capable of being gang formed for setting in position or stripped as an integral monolithic footing and wall forming unit, and must be rigidly constructed and interconnected in such manner as to be self-straightening and non-sagging, without the need for additional walers and strongbacks. Such panels must support the footing forming members attached thereto so that no wasteful interconnecting members between opposing footing forms are necessary, thereby allowing such monolithic footing and wall forming units to be stripped as an integral one-piece structure. These advantages and more are provided by my new wall forming system, which is described and shown in more detail hereinafter.

BRIEF SUMMARY OF THE INVENTION

It is the principal object of this invention to provide a plurality of relatively light-weight, easy to handle rigid wall forming panels, each having a monolithic footing forming member adjustably mounted thereto in supported relation. Such wall forming panels are to be uniformally and symmetrically constructed for ease of manipulation, and for purposes of facilitating gang forming thereof into integral unitary monolithic footing and wall forming units which are self-straightening and non-sagging, and capable of being readily set in position and stripped as an integral one-piece unit through the use of a crane or other suitable hoisting device.

To accomplish the above objectives, I have developed a wall forming apparatus for constructing monolithic concrete footings and foundation walls which includes a plurality of relatively light-weight prefabricated wall forming panels, each of which has a rigid peripheral framework constructed of metal onto which a rigid inner planar surface member is connected. Depending in supported relation from the lower peripheral frame section of each panel, and adjustably attached thereto, is a rigid footing forming member which is preferably constructed of an extruded metal, but may be fabricated in a machine shop, depending on the number of footing and wall forming units needed.

A plurality of such panels and attached footing forms may be gang formed by rigidly interconnecting the same, and hoisted into desired position via the use of a crane or other suitable method so as to form a plurality of opposing monolithic footing and wall forming units which define the outer confines of the building foundation to be formed. Such monolithic footing and wall forming units may be set in position and stripped easily as integral units, since no interconnecting members are required to extend between opposing footing forms. Moreover, the construction of the peripheral framework of each panel eliminates the need for additional walers and strongbacks for proper alignment of adjacent panels.

Each footing forming member includes a plurality of mounting holes located adjacent opposite ends thereof, which allows the same to be adjusted inwardly or outwardly relative to the inner planar surface of the wall forming panel to which it is connected. By adjusting the footing forms inwardly and outwardly, footings of varying widths may be formed relative to the desired wall thickness.

Each footing forming member is also constructed in such manner that the means for connecting such footing forming members to the respective wall forming panels does not extend within the concrete receiving cavity defined between opposing footing and wall forming units. To accomplish this, the portion of each footing forming member which abuts the lower peripheral frame section of each respective wall forming panel is formed to define an open area immediately beneath the wall forming panel into which the connecting means may extend without entering the concrete receiving cavity between opposing wall panels. In the preferred embodiment of my invention, the abutting portion of each footing forming member includes an angularly disposed portion which extends downwardly and outwardly from the inner planar surface of the wall forming panel to which it is connected, thereby defining an open area between the abutting portion of the footing forming member and the angularly disposed portion thereof.

Because the connecting means between the footing forms and wall forming panels do not extend within the concrete receiving cavity, and because opposing footing forms are devoid of any interconnecting supports therebetween, the only portion of my wall forming apparatus which extends within the concrete receiving cavity are the ties which hold such opposing footing and wall forming units in proper spaced relation. Thus, by avoiding the extension of any unnecessary parts within the concrete receiving cavity formed between opposing footing and wall forming units, such units may be easily stripped as integral one-piece units once the concrete has hardened.

As described above, each wall forming panel is constructed uniformly and symmetrically such that adjacent panels can be rigidly interconnected or gang formed to form opposing footing and wall forming units. Such panels may be placed face down with their inner planar surface laying on a large substantially flat surface, such as that provided by a flatbed truck or trailer, and adjacent panels may be rigidly interconnected to form the monolithic footing and wall forming units which may be used and reused between different job sites.

The peripheral frame sections of each wall forming panel are constructed of a rigid metal and have a cross-sectional width which is sufficient to prevent canting and consequent misalignment between adjacent panels when such panels are rigidly connected immediately adjacent their upper and lower peripheral frame sections. The abutting portions of each adjacent wall forming panel are milled flat so that such rigid interconnection thereof will ensure proper alignment of such panels. There is no need for additional walers and strongbacks due to the relatively wide cross section of the frame sections, and their rigid interconnection adjacent the upper and lower frame sections thereof.

Interconnection of such panels immediately adjacent to the upper and lower peripheral frame sections also helps to prevent sagging or bowing of such wall forming panels from the substantial weight which is created by gang forming such panels. Preferably, each wall forming panel is constructed to be 4'×8' in dimensions, and weighs no more than about 180 pounds, but preferably 140 pounds or less, to facilitate ease of manipulation and maneuverability. Once gang formed, it is preferable that each footing and wall forming unit not exceed 40' in length, and should not weigh more than approximately 2400 pounds, including accessory hardware, so that a smaller, less costly crane may be used for positioning and stripping the same.

By constructing and interconnecting the wall forming panels in the above manner, rigid monolithic footing and wall forming units may be formed which are self-straightening and non-sagging, without the need for additional walers and strongbacks to support the same. Each individual wall forming panel is light enough for fairly easy hand maneuverability, if necessary, and each monolithic footing and wall forming unit which is constructed may be used and reused without disassembly thereof.

BRIEF DESCRIPTION OF THE DRAWINGS

These and other objects and advantages of the invention more fully appear from the following description, made in connection with the accompanying drawings, wherein like reference characters refer to the same or similar parts throughout the several views, and in which.

DETAILED DESCRIPTION OF THE INVENTION

Figure 1:
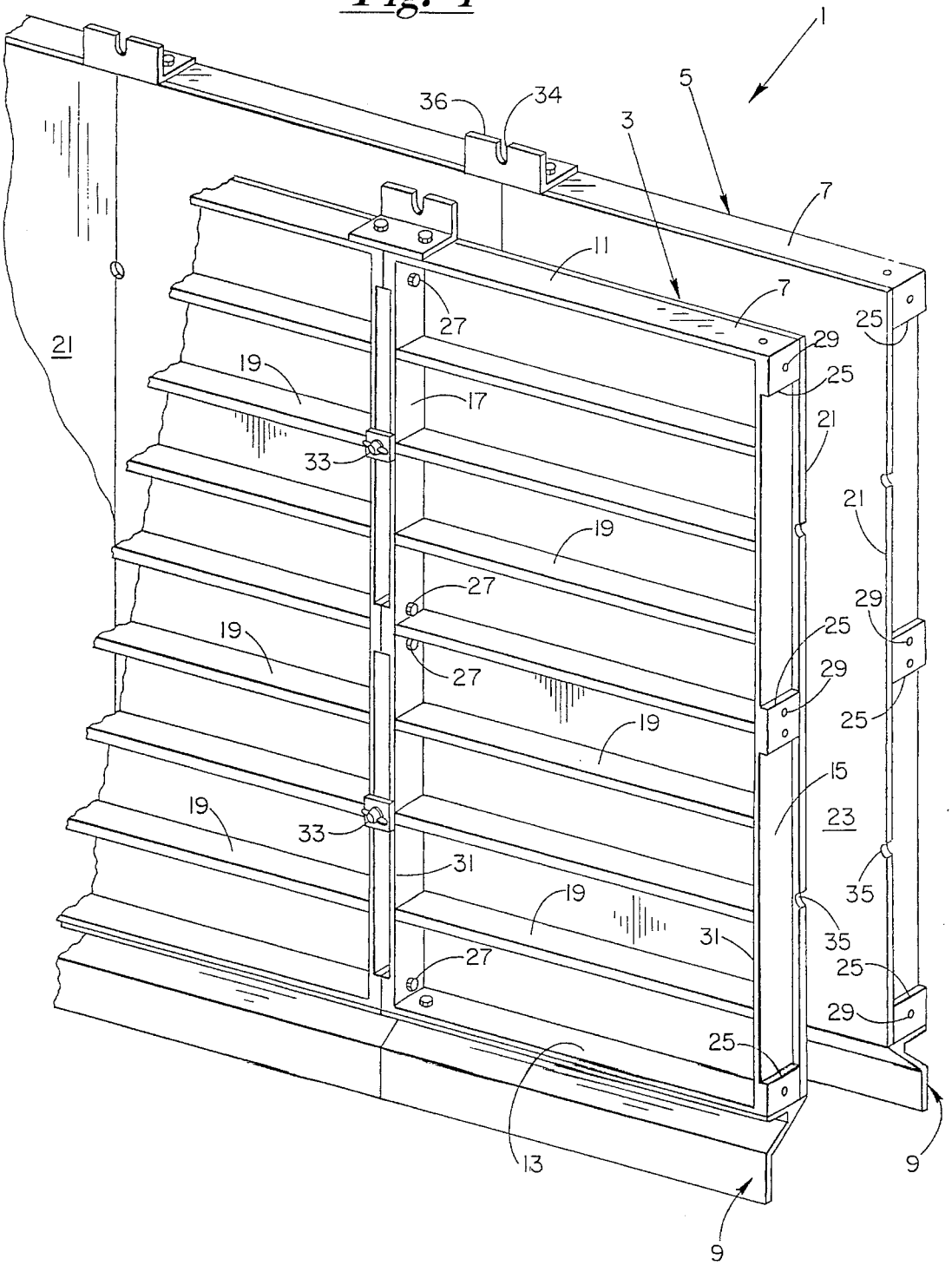
FIG. 1 is a perspective view of a portion of my improved concrete wall forming apparatus, showing the individual construction of each monolithic footing and wall forming panel, and showing the gang forming and positioning of such panels to form spaced opposing integral monolithic footing and wall forming units which receive the poured concrete therebetween.

Shown in FIG. 1 of the enclosed drawings is my improved concrete wall forming apparatus 1 which is generally comprised of a pair of spaced opposing integral monolithic footing and wall forming units 3 and 5. Each of the monolithic footing and wall forming units 3 and 5 is comprised of a plurality of interconnecting uniformly and symmetrically constructed light weight prefabricated wall forming members 7, each of which carrys at its lower end an adjustable footing forming member 9. Each wall forming member 7 is constructed of a rigid framework comprising an upper peripheral frame section 11, a lower peripheral frame section 13, and opposite side frame sections 15 and 17 extending between and interconnecting the upper and lower peripheral frame sections 11 and 13. Extending laterally between opposite side frame sections 15 and 17, and disposed parallel with upper and lower frame sections 11 and 13, are a plurality of spaced central rigid support members 19 which add rigidity to each wall forming panel. Attached to the inner surface of the framework of each wall forming member 7 is a panel 21 having an inner planar surface 23.

As mentioned previously, all such integral monolithic footing and wall forming units such as that shown by numerals 3 and 5 in FIG. 1 are substantially self-straightening and non-sagging. In order to accomplish the same, the framework of each wall forming member 7 is generally constructed of metal or other sufficiently rigid material. Each side peripheral frame section 15 and 17 are constructed with a plurality of reinforced raised connecting blocks 25 which are milled substantially flat and perpendicular to a plane defined by the inner surface of the framework to which panel 21 is connected, thereby defining a substantially straight-line along the upper and lower horizontal edges of peripheral frame sections 11 and 13. Preferably, blocks 25 should be milled flat as described above to within a tolerance of about 0.010 inch. Also, reinforced connecting blocks 25 are preferably disposed at least immediately adjacent the upper frame section 11 and lower frame section 13 of the framework for each wall forming member 7, therefor allowing rigid interconnection of adjacent wall forming members 7 immediately adjacent the upper and lower ends thereof. Interconnection of such adjacent wall forming members 7 is accomplished through the use of rigid bolt 27 which passes through openings 29 in the reinforced connecting blocks of each peripheral side frame section 15 and 17.

Figure 9:
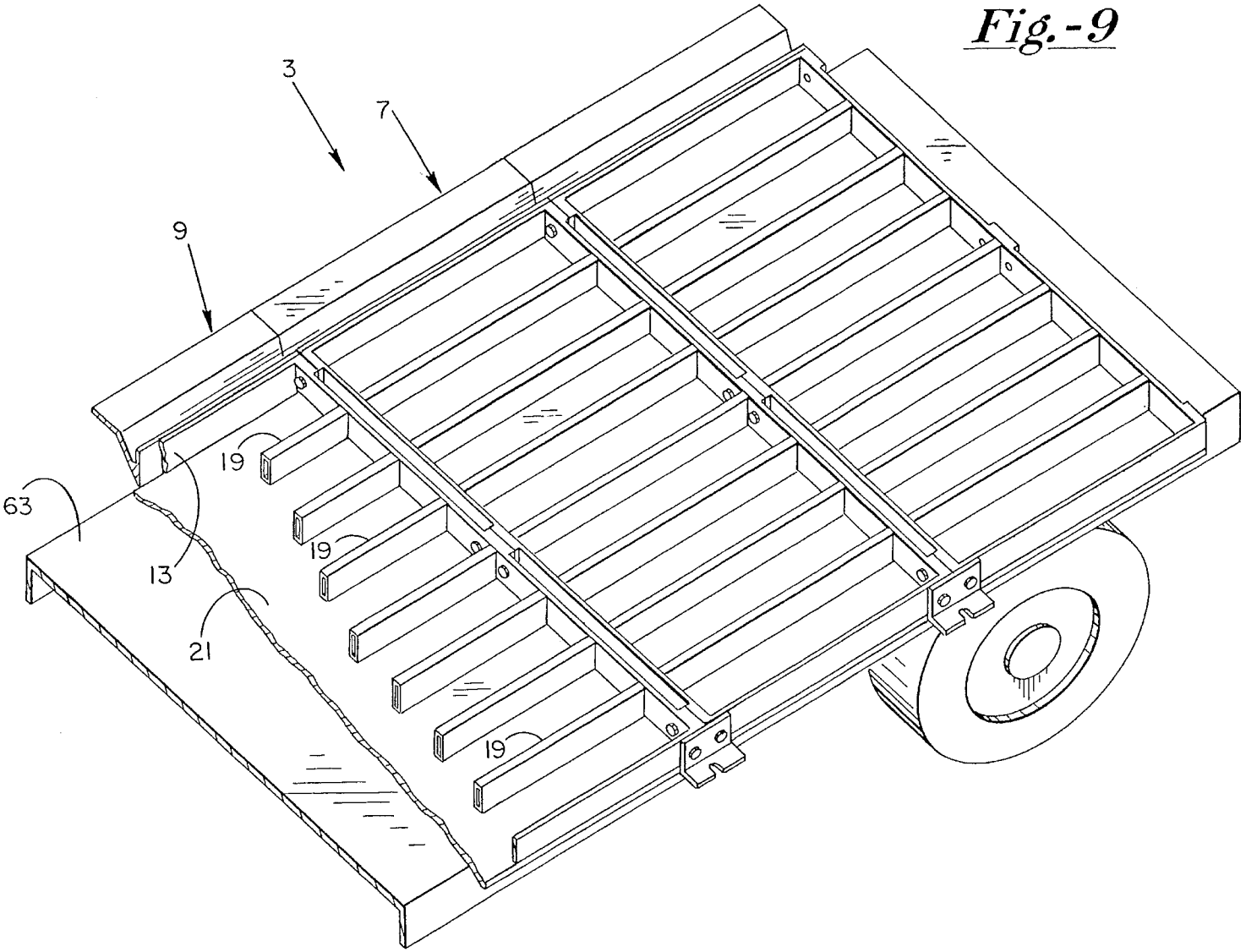
FIG. 9 is a perspective view of a plurality of wall forming panels prefabricated into an integral monolithic footing and wall forming unit in accordance with my invention on a substantially flat surface, such as a flatbed truck or trailer.

At least the upper and lower peripheral frame sections 11 and 13, and adjacent connecting blocks 25 are constructed such that the width from its rearmost surface 31 to the inner surface to which panel 21 is connected is not less than approximately 3 inches, thereby providing a much broader framework than that used in conventional residential wall forming systems. The advantage in constructing the framework of wall forming members 7 with substantially broader connecting portions immediately adjacent the upper and lower peripheral frame sections 11 and 13, and milling connecting blocks 25 to within the approximate tolerance set forth above, is that rigid side-by-side interconnection of such wall forming members 7 adjacent the upper and lower ends thereof will substantially eliminate any inward or outward canting of one wall forming member 7 relative to another. Consequently, such interconnected wall forming members 7 become substantially self-straightening, without the need for additional walers and strongbacks for increased support and alignment. Moreover, the additional strength provided by the reinforced connecting blocks 25 causes the integral monolithic footing and wall forming units 3 and 5 to be substantially non-sagging when hoisted via a crane in the manner as shown in FIG. 9.

Figure 2:
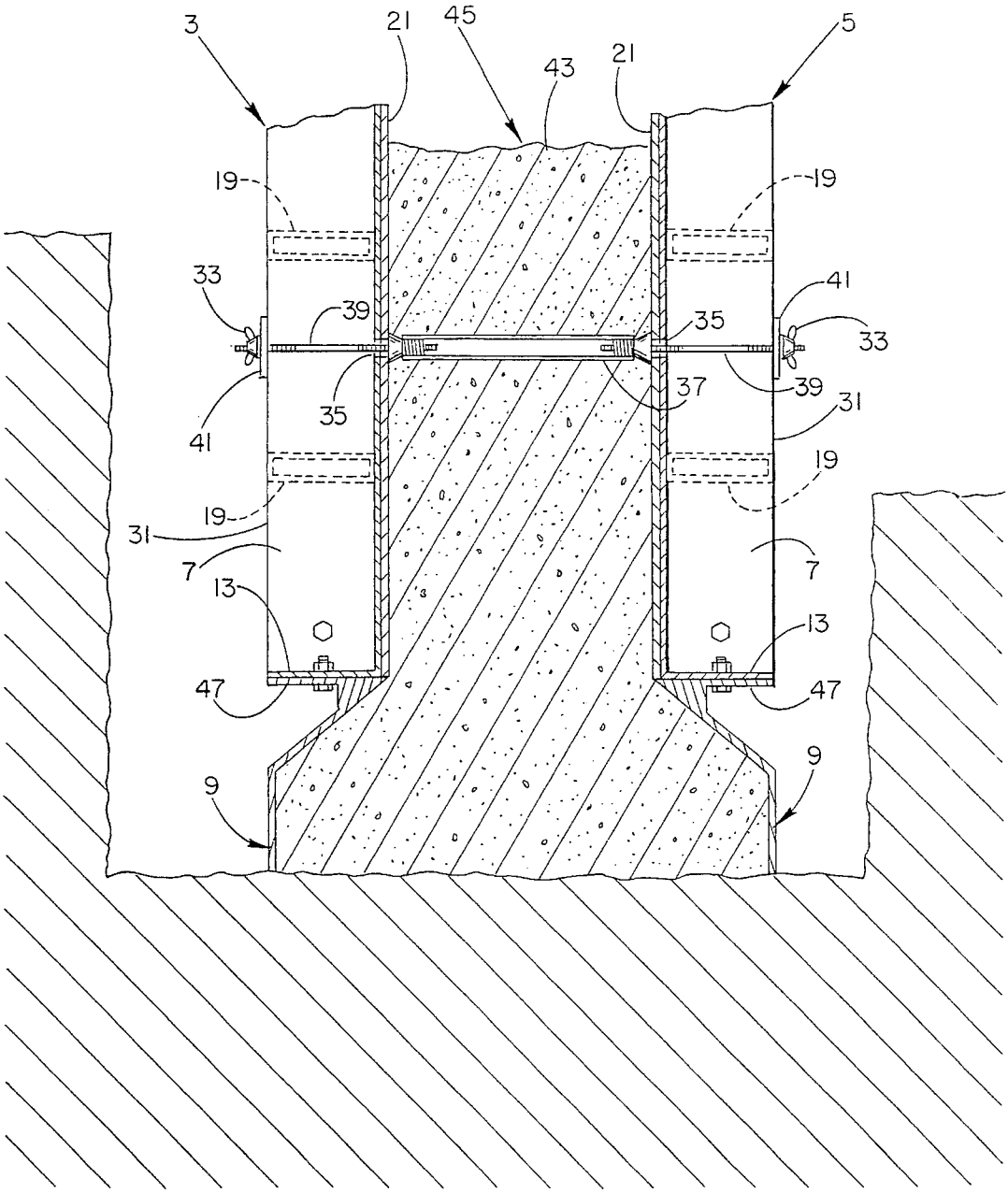
FIG. 2 is a vertical cross sectional view of my improved concrete wall forming apparatus, showing the apparatus as used with interconnecting tieing members and adjustable monolithic footing forming members attached to the wall forming panels thereof.

As shown in FIG. 2, once each integral wall forming unit 3 and 5 have been set in place in their desired spaced relation within an excavated ditch, a tieing means 33 is used to interconnect the opposing wall forming units and retain the same in proper spaced relation. As shown in FIG. 2, a coil tieing arrangement is used, although there are many other tieing arrangements which can be employed to accomplish the same result. As shown best in FIG. 1, coil tieing members 33 are disposed between side-by-side interconnected wall forming members 7 and are properly positioned and seated within notches 35 which are formed on opposite side edges of panel 21. Each tieing means 33 is comprised of a coil tie 37 which threadingly receives within each of its opposite ends a coil bolt 39. Coil bolt 39 bears against washer 41 which, in turn, bears against the rear surface 31 of the interconnected side peripheral frame sections of adjacent wall forming members 7. Generally a plurality of tieing members 33 are utilized at each joint between interconnecting wall forming members 7 to hold the opposing monolithic wall forming units 3 and 5 in proper spaced relation. An additional overhead tie (not shown) may be used to secure the top ends of opposing footing and wall forming units 3 and 5 together by seating such a tieing means 33 within notches 34 of upper tie brackets 36. Once all tieing members 33 are properly connected, concrete 43 may be poured into the concrete receiving cavity 45 which is formed between opposing monolithic footing and wall forming units 3 and 5.

Figure 4:
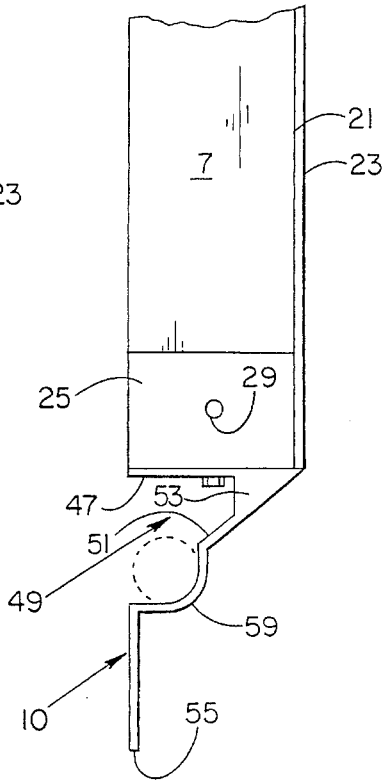
FIG. 4 is a partial side elevational view of the lower portion of a wall forming panel, showing an alternative embodiment of a footing forming member wherein a drain tile seat form is constructed integrally therewith.
Figure 5:
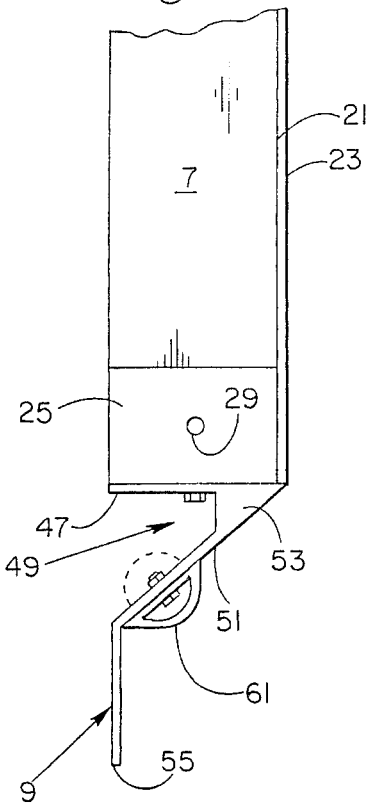
FIG. 5 is a partial side elevational view of the lower portion of a wall forming panel, showing another alternative embodiment of the footing forming member wherein a drain tile seat form may be constructed via the attachment of an accessory piece for forming the same.
Figure 6:
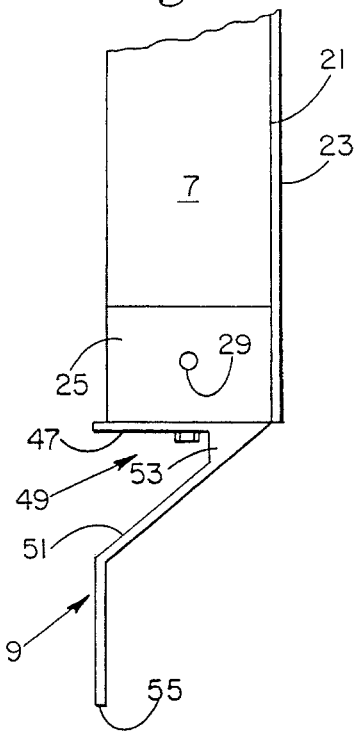
FIG. 6 is a partial side elevational view of the lower portion of a wall forming panel, showing the adjustability of the footing forming member relative to the wall forming panel to which it is attached.
Figure 7:
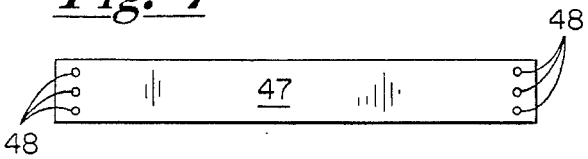
FIG. 7 is a top plan view of a footing forming member which attaches to a wall forming panel, showing a plurality of openings at each end for adjustability thereof.

As is best shown in FIGS. 2–6, the footing forming member 9 which is attached to the lower peripheral frame section 13 of each footing forming member 7 includes an abutting mounting portion 47 which includes a plurality of mounting holes 48 disposed at opposite ends thereof (FIG. 7) which allow for adjustable connection thereof to a wall forming member 7, as shown in FIG. 6. From the point of the abutting portion 47 which is most inwardly disposed and adjacent to the inner planar surface 23 of panel 21, footing forming member 9 preferably extends angularly downward and outward, thereby forming an open area 49 disposed between abutting portion 47 and angularly disposed portion 51 of forming member 9. The joint between abutting portion 47 and angular portion 51 is reinforced or gusseted at point 53 to provide added strength for support of the weight of wall forming member 7, and for withstanding the pressure from the poured liquid concrete. Footing forming member 9 extends downwardly from the outer terminal end of angular portion 51 to its bottom terminal portion 55. Although the preferred construction is as shown in the accompanying drawings, it is conceivable that other configurations of footing forming member 9 may be used, so long as an open area 49 is formed thereby.

The importance of open area 49 in footing forming member 9 lies in the fact that it is important that no portion of the wall forming apparatus extend within the concrete receiving cavity 45, other than the tieing means 33, which is accessibly disposed above the lower peripheral frame section 13 of a wall forming member 7. This facilitates ease in stripping the integral monolithic footing and wall forming units once the concrete has set and hardened. By forming open area 49, the interconnecting bolt 57 between footing forming member 9 and wall forming member 7 to which it is connected does not extend within the concrete receiving cavity 45, and will therefore not become lodged within the concrete 43 so as to prohibit easy and efficient stripping of the forms therefrom once the concrete has hardened. It also prevents the threads of the connecting nuts and bolts from becoming coated with concrete, thereby facilitating ease in adjustment of the footing forming members 9 when such an adjustment is desired.

Another significant advantage resulting from the prefabrication of such monolithic footing and wall forming units is that the footing forming members 9 are built down from the wall forming members 7, rather than the wall forming members being built up from the footing forms, as in conventional wall forming systems which are constructed in a piecemeal manner on the job site. Because each wall forming member 7 carries its respective footing forming member 9, there is no need for interconnecting members between opposing footing forming members 9 when set into position prior to the pouring of concrete. As such, stripping of the monolithic footing and wall forming members 3 and 5 after the concrete has hardened only requires disconnection of the accessible tieing means 33 disposed above the lower peripheral frame section 13 of the wall forming members 7 thereof. This is a significant time savings over conventional footing wall forming systems which are constructed at the job site.

Figure 3:
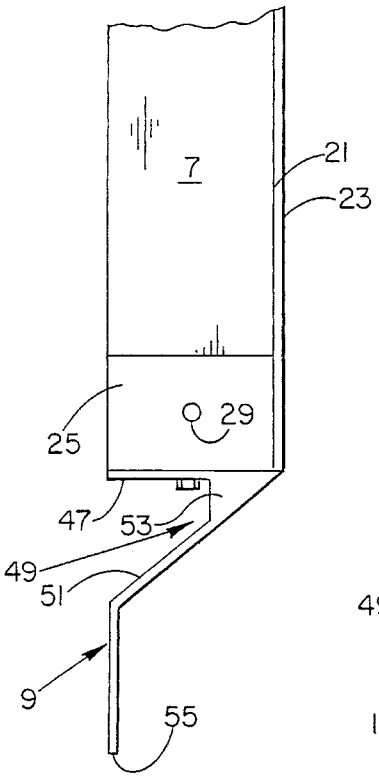
FIG. 3 is a partial side elevational view of the lower portion of a wall forming panel, showing the preferred construction of the footing forming member which attaches to the wall forming panel.

As best shown in FIGS. 4 and 5, the footing forming members may be alternatively designed so as to form a drain tile seat in the resulting concrete footing formed thereby. As shown in FIG. 4, angular portion 51 of footing forming member 10 may be constructed with an integral inwardly protruding arcuate portion 59 which, upon pouring of the concrete, will form a seat upon which drain tile (shown in phantom lines) may rest prior to backfilling dirt against the formed concrete wall. Alternatively, as shown in FIG. 5, a standard footing forming member 9 may be modified to carry an arcuately shaped attachment 61 which serves the same purpose as the integrally formed arcuate portion 59 in FIG. 4. Use of the arcuate attachment 61 is advantageous in that the standard footing forming member 9, as shown in FIG. 3, may be utilized without the need for manufacturing a complete separate line of footing forming members in the configuration as shown in FIG. 4.

In operation, as shown in FIG. 9, a plurality of integral monolithic footing and wall forming units such as that designated as 3 and 5 in the instant disclosure may be constructed on a substantially flat surface, such as a flatbed truck or trailer 63, which may also be used for transportation of the same. Once constructed, such integral monolithic wall forming units may be transported from job site to job site without disassembly thereof. Therefore, use of a flatbed truck or trailer 63 allows for both prefabrication and transportation of the monolithic footing and wall forming units, which greatly reduces the amount of assembly time for the same.

To construct such units 3 and 5, a plurality of wall forming members 7 having monolithic footing forming members 9 attached to the lower peripheral frame section 13 thereof are laid face down with inner planar surface 23 of panel 21 lying on the flat surface of the flatbed truck or trailer 63, or on other panels disposed therebelow. Such wall forming panels are abutted together in side-by-side relation and rigidly interconnected at least at points immediately adjacent the upper and lower ends thereof, as shown in FIG. 9. Preferably, no more than approximately ten wall forming panels 7 are interconnected in side-by-side relation, so that each integral monolithic footing and wall forming unit 3 or 5 extends only approximately 40 feet in length, and does not exceed approximately 2,400 pounds in weight. If such limitations are adhered to, a smaller and less costly crane may be used to manuever and set the same.

Figure 8:
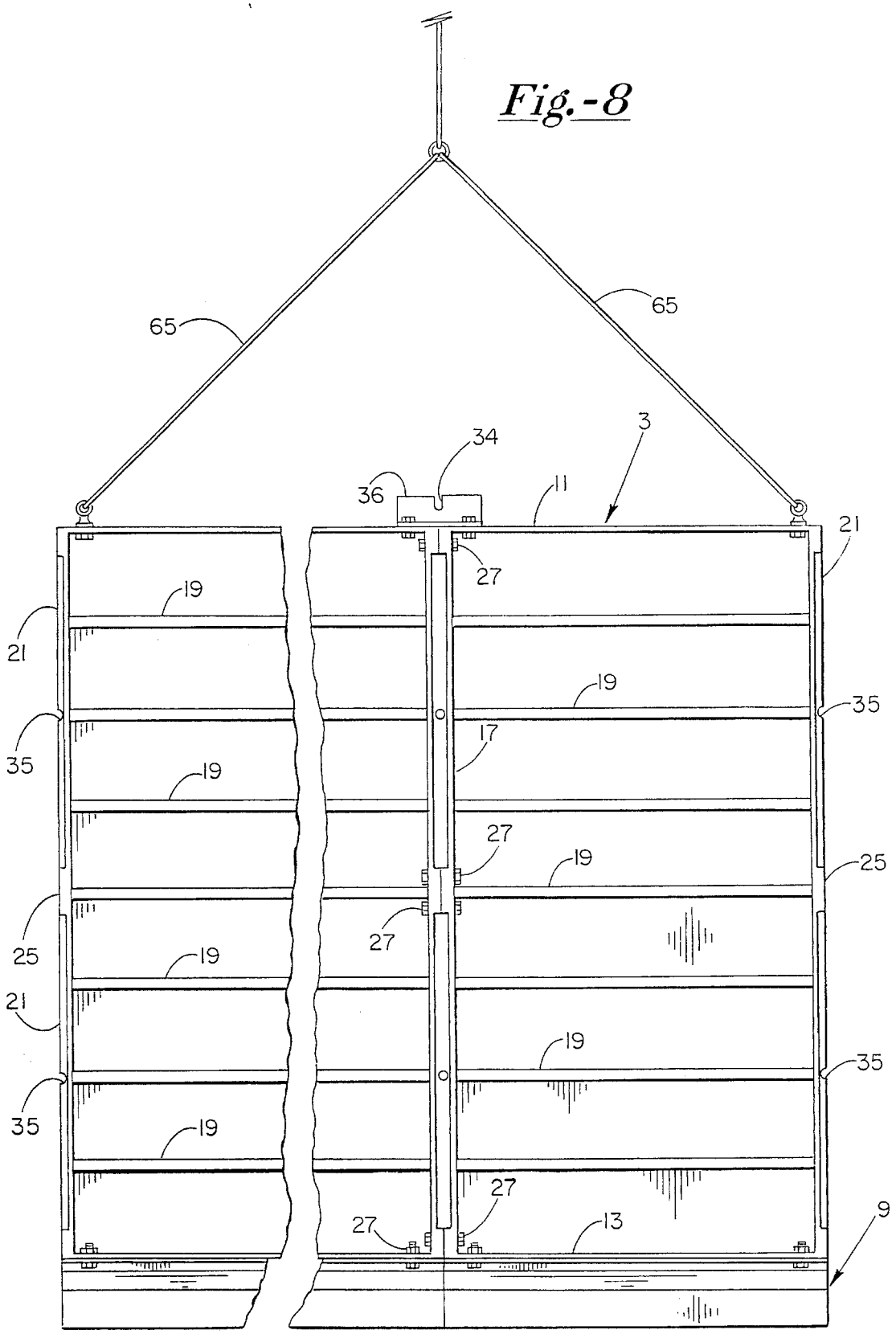
FIG. 8 is a rear elevational view of an integral monolithic footing and wall forming unit, having vertical break lines to represent the interconnection of a plurality of wall forming panels to form the integral unit, and showing the means by which such integral footing and wall forming units may be hoisted and moved into a desired position.

Once such integral monolithic footing and wall forming units are constructed, appropriate rigging 65 is connected to such units 3 and 5, and a crane, knuckle-boom or other suitable device is used to hoist such units as shown in FIG. 8 of the enclosed drawing. Such units may be readily set in desired position within an excavated trench, and appropriately supported until further footing and wall formings units are put in place and tied together so as to form the entire wall forming apparatus for the desired foundation.

It will, of course, be understood that various changes may be made in the form, details, arrangement and proportions of the parts without departing from the scope of the invention which comprises the matter shown and described herein and set forth in the appended claims.

I claim:

1. A wall forming apparatus for constructing monolithic concrete walls and footings, comprising:

(a) at least one pair of rigid wall forming panels being spaced apart and oppositely disposed relative to one another, each of said wall forming panels having elongated top, bottom and side peripheral frame portions, an inner planar concrete forming surface and an opposing outer surface;

(b) each of said opposing wall forming panels having an elongated rigid footing forming member depending from said bottom peripheral frame portion thereof, thereby defining at least one pair of spaced opposing integral footing and wall forming units with a coextensive concrete receiving cavity therebetween for forming a monolithic concrete footing and wall;

(c) means for adjustably connecting each said footing forming member to said wall forming panel from which it depends to vary the position of said footing forming member relative to said wall forming panel from which it depends;

(d) tieing means disposed above said footing forming members and extending between said opposing wall forming panels for maintaining said opposing footing and wall forming units in desired spaced relation during the pouring of concrete within said concrete receiving cavity; and (e) said concrete receiving cavity being devoid of any structure extending within the confines thereof below said bottom peripheral frame portion of said wall forming panels.

2. The structure defined in claim 1, wherein at least one of said footing forming members includes means for forming a drain tile seat in the footing of the concrete wall.

3. The structure defined in claim 1, wherein at least one of said footing forming members includes an abutting portion which abuts and connects to said bottom peripheral portion of said wall forming panel from which it depends, said abutting portion being constructed to define an accessible area outside said concrete receiving cavity into which said connecting means extends for ready adjustability thereof.

4. The structure defined in claim 3, wherein said abutting portion of said footing forming member is angularly shaped and has diverging first and second legs, said first leg extending generally parallel to said bottom peripheral portion of said wall forming panel from which it depends, and said second leg being cantilevered from said first leg and extending at an acute angle thereto, said first and second legs defining said accessible area therebetween into which said connecting means extends for ready adjustability thereof.

5. The structure defined in claim 1, wherein at least one of said footing forming members is generally angularly shaped with diverging legs extending outwardly from a point adjacent to said inner planar concrete forming surface of said wall forming panel from which it depends.

6. The structure defined in claim 5, wherein one of said legs of said footing forming member is connected to said bottom peripheral portion of said wall forming panel from which it depends via said adjustable connecting means, and said other leg diverges generally outwardly and downwardly therefrom at an acute angle.

7. The structure defined in claim 6, wherein said diverging legs of said footing forming members define an accessible area therebetween into which said connecting means extends for ready adjustability thereof.

8. The structure defined in claim 5, wherein one of said legs defines an arcuate detent for forming a drain tile seat in the footing of the concrete wall.

9. The structure defined in claim 5, wherein said footing forming member is constructed from an extruded or fabricated metal.

10. The structure defined in claim 1, wherein said means for adjustably connecting each said footing forming member to said wall forming panel from which it depends includes means for aligning said footing forming member at predetermined positions relative to said wall forming panel from which it depends.

11. The structure defined in claim 1, wherein said peripheral frame portions are constructed of metal and each of said wall forming panels is constructed to be approximately four feet in width by eight feet in height, and weigh less than approximately one hundred eighty pounds to facilitate ease in hand manipulation thereof.

12. The structure defined in claim 11, wherein the cross-sectional dimension of each of said peripheral frame portions, measured from said outer surface toward said inner planar surface, is not less than approximately three inches.

13. The structure defined in claim 1, wherein each of said peripheral frame portions is constructed of rigid metal and has a cross-sectional dimension measured from said outer surface toward said inner planar surface of not less than three inches, said top and bottom peripheral frame portions of each of said wall forming panels each having opposite ends which are flat to within approximately 0.010 inch of a plane disposed normal to the longitudinal axis of said top and bottom frame portions.

14. A wall forming apparatus for constructing monolithic concrete walls and footings, comprising:

(a) at least one pair of rigid wall forming panels being spaced apart and oppositely disposed relative to one another, each of said wall forming panels having elongated top, bottom and side peripheral frame portions, a separate inner planar concrete forming surface attached to said frame portions, and an opposing outer surface;

(b) each of said opposing wall forming panels having an elongated rigid footing forming member depending from said bottom peripheral frame portion thereof, thereby defining at least one pair of spaced opposing integral footing and wall forming units with a coextensive concrete receiving cavity therebetween for forming a monolithic concrete footing and wall;

(c) means for positively connecting each of said footing forming members to said wall forming panel from which it depends;

(d) tieing means disposed above said footing forming members and extending between said opposing wall forming panels for maintaining said opposing footing and wall forming units in desired spaced relation during the pouring of concrete within said concrete receiving cavity; and (e) each of said opposing footing and wall forming units being independently prefabricated as separate integral one-piece portable units and constructed to be free of interconnecting structure extending directly between said opposing footing forming members to facilitate free release of said footing and wall forming units as independent integral one piece units upon release of said tieing means after proper hardening of the monolithic concrete wall and footing formed thereby.

15. The structure defined in claim 14, wherein at least one of said footing forming members includes means for forming a drain tile seat in the footing of the concrete wall.

16. A wall forming apparatus for constructing monolithic concrete walls and footing, comprising;

(a) at least one pair of rigid wall forming panels being spaced apart and oppositely disposed relative to one another, each of said wall forming panels having elongated top, bottom and side peripheral frame portions, an inner planar concrete forming surface, and an opposing outer surface;

(b) each of said opposing wall forming panels having an elongated rigid footing forming member depending from said bottom peripheral frame portion thereof, thereby defining at least one pair of spaced opposing integral footing and wall forming units with a coextensive concrete receiving cavity therebetween for forming a monolithic concrete footing and wall;

(c) means for connecting each of said footing forming members to said wall forming panel from which it depends;

(d) tieing means disposed above said footing forming members and extending between said opposing wall forming panels for maintaining said opposing footing and wall forming units in desired spaced relation during the pouring of concrete within said concrete receiving cavity;

(e) each of said opposing footing and wall forming units being independently prefabricated and constructed to be free of interconnecting structure extending directly between said opposing footing forming members to facilitate free release of said monolithic footing and wall forming units as independent integral one piece units upon release of said tieing means after proper hardening of the monolithic concrete wall and footing formed thereby; and (f) at least one of said footing forming members including an abutting portion which abuts and connects to said bottom peripheral portion of said wall forming panel from which it depends, said abutting portion being constructed to define an accessible area outside said concrete receiving cavity into which said connecting means extends.

17. The structure defined in claim 16, wherein said connecting means is adjustable and said abutting portion of said footing forming member is angularly shaped with diverging first and second legs, said first leg extending generally parallel to said bottom peripheral portion of said wall forming panel from which it depends, and said second leg being cantilevered from said first leg and extending at an acute angle thereto, said first and second legs defining said accessible area therebetween into which said connecting means extends for ready adjustability thereof.

18. The structure defined in claim 14, wherein said peripheral frame portions are constructed of metal and each of said wall forming panels is constructed to be approximately four feet in width by eight feet in height, and weigh less than approximately one hundred eighty pounds to facilitate ease in hand manipulation thereof.

19. The structure defined in claim 14, wherein each of said peripheral frame portions is constructed of rigid metal and has a cross-sectional dimension measured from said outer surface toward said inner planar surface of not less than three inches, said top and bottom peripheral frame portions of each of said wall panels each having opposite ends which are flat and disposed normal to within approximately 0.010 inches of the longitudinal axis of said top and bottom frame portions.

* * * * *